US007902948B2

(12) United States Patent
Lüders

(10) Patent No.: US 7,902,948 B2
(45) Date of Patent: Mar. 8, 2011

(54) SWITCHING DEVICE, IN PARTICULAR A POWER SWITCHING DEVICE, HAVING TWO PAIRS OF SERIES-CONNECTED SWITCHING CONTACTS FOR INTERRUPTING A CONDUCTING PATH

(75) Inventor: Carsten Lüders, Amberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/319,859

(22) Filed: Jan. 13, 2009

(65) Prior Publication Data

US 2009/0179009 A1 Jul. 16, 2009

(30) Foreign Application Priority Data

Jan. 14, 2008 (DE) ..... 10 2008 005 115

(51) Int. Cl.

| | |
|---|---|
| ***H01H 9/30*** | (2006.01) |
| ***H01H 67/00*** | (2006.01) |
| ***H01H 67/02*** | (2006.01) |
| ***H01H 63/02*** | (2006.01) |
| ***H01H 1/00*** | (2006.01) |
| ***H01H 9/40*** | (2006.01) |
| ***H01H 33/14*** | (2006.01) |
| ***H01H 33/18*** | (2006.01) |
| ***H01H 33/70*** | (2006.01) |

(52) U.S. Cl. ..... 335/201; 335/106; 335/107; 335/133; 335/196; 218/4; 218/31; 218/34; 218/69; 218/146; 218/149

(58) Field of Classification Search ..... 335/12, 335/41, 57, 60, 83, 88, 97, 106, 107, 133, 335/147, 196, 201; 218/4, 22–42, 69, 115, 146, 147, 149, 155–158
See application file for complete search history.

(56) References Cited

U.S. PATENT DOCUMENTS

| | | | | |
|---|---|---|---|---|
| 1,866,495 | A * | 7/1932 | Wedmore | 218/31 |
| 3,068,379 | A * | 12/1962 | Cole | 361/115 |
| 3,593,227 | A * | 7/1971 | Mitskevich et al. | 335/16 |
| 3,959,753 | A * | 5/1976 | Wafer | 335/16 |
| 4,656,446 | A * | 4/1987 | Chien et al. | 335/201 |
| 5,073,764 | A * | 12/1991 | Takahashi et al. | 335/16 |
| 6,184,761 | B1 * | 2/2001 | Doma et al. | 335/16 |
| 6,232,570 | B1 * | 5/2001 | Castonguay et al. | 218/146 |
| 6,534,737 | B1 * | 3/2003 | Rademacher et al. | 200/401 |
| 7,541,901 | B2 * | 6/2009 | Nakano et al. | 335/201 |
| 2009/0321233 | A1 | 12/2009 | Ferree | |

FOREIGN PATENT DOCUMENTS

| | | | |
|---|---|---|---|
| DE | 3810977 | A1 | 10/1989 |
| DE | 19629867 | A1 | 5/1998 |
| DE | 19517634 | C2 | 1/2002 |
| DE | 112007003283 | T5 | 2/2010 |
| EP | 0174904 | A1 | 3/1986 |

* cited by examiner

*Primary Examiner* — Lincoln Donovan
*Assistant Examiner* — Mohamad A Musleh

(57) ABSTRACT

A switching device, in particular a power switching device, has two pairs of series-connected switching contacts for interrupting a conducting path and at least one quenching packet, disposed near the pairs of switching contacts, for quenching the arcs occurring when the conducting path opens. The pairs of switching contacts are arranged such that their opening paths are substantially mutually parallel or antiparallel. The pairs of switching contacts are connected in series such that the same current flowing in both arcs flows spatially in the same direction. The quenching packet is disposed in the area between the opening paths.

9 Claims, 4 Drawing Sheets

SWITCHING DEVICE, IN PARTICULAR A POWER SWITCHING DEVICE, HAVING TWO PAIRS OF SERIES-CONNECTED SWITCHING CONTACTS FOR INTERRUPTING A CONDUCTING PATH

CROSS REFERENCE TO RELATED APPLICATIONS

This application claims priority of German application No. 10 2008 005 115.2 DE filed Jan. 14, 2008, which is incorporated by reference herein in its entirety.

FIELD OF INVENTION

The invention relates to a switching device having two pairs of series-connected switching contacts for interrupting a conducting path and having at least one quenching packet, disposed near the pairs of switching contacts, for quenching the arcs occurring when the conducting path opens. The pairs of switching contacts are arranged such that their opening paths are substantially mutually parallel or antiparallel.

The invention relates particularly to switching devices, especially to power switching devices operating in the low-voltage range, meaning up to voltages of approximately 1,000 volts. Switching devices of said type are embodied particularly for interrupting conducting paths in the event of shorting or overcurrent. The switching devices can furthermore be of single-pole or multi-pole, in particular three-pole, design.

BACKGROUND OF INVENTION

The power switching devices under consideration are, for example, what are termed MCCB (Molded-Case Circuit Breaker) switching devices. In the case of a switching device of said kind the current requiring to be interrupted is interrupted before reaching its maximum value through pulling apart of the MCCB's switching contacts owing to adjacent conductors' electromagnetic repulsion, and the current's being interrupted thereby. The maximum current can be in the single- to three-digit kA range.

Alternatively or in addition, the switching contacts can be actuated by means of, for example, a preferably electromagnetically operable actuator. The actuator can be driven by, for example, an overcurrent-sensing unit.

The quenching packet(s) employed near the pairs of switching contacts or, as the case may be, double contact serve(s) to cool the hot arc plasma when the switching contacts open. Cooling the plasma causes the electric conductivity to be lowered such that the resistance in the arc will be increased, the reverse voltage increased, and the current interrupted.

What is problematic with the switching devices in current use is that the arcs occurring when the switching contacts open tend rather not to run into the cold metal sheets. It is known, for example, to employ what are termed blowout magnets to eliminate that problem. That, though, is not a satisfactory solution for all switching actions, or one that is too effort-intensive.

SUMMARY OF INVENTION

Proceeding from the prior art cited in the introduction it is therefore an object of the invention to disclose an improved switching device.

The object of the invention is achieved by means of a switching device, in particular a power switching device, having the features of the independent claim. Advantageous embodiments are disclosed in the dependent claims.

According to the invention the pairs of switching contacts are connected in series such that the same current flowing in both arcs flows spatially in the same direction. The quenching packet is disposed in the area between the two opening paths.

A major basic notion underlying the invention is that currents flowing in the same direction attract each other owing to the Lorentz force in effect. In other words the two arcs through which the same current is flowing attract each other. The fact that the quenching packet is disposed between the two arcs causes them to be, as it were, driven into the quenching packet. The arcs will both be cooled rapidly and the current consequently interrupted advantageously quickly.

According to one embodiment of the invention the pairs of switching contacts each have a movable switching contact and a fixed contact. One of the movable switching contacts is electrically connected to the fixed contact of the other pair of switching contacts. The remaining two switching contacts are each connected to the conducting path. What is achieved by that circuitry arrangement is that the current in both arcs will flow in the same direction.

According to another embodiment the two movable switching contacts are each mounted such that they can swivel around a pivotal center. Both free ends of the movable switching contacts border the quenching packet, with a minimum air gap of a few millimeters being maintained. The free ends of the switching contacts customarily each have a switching contact piece. Swivel mounting advantageously enables fast opening of the switching contacts.

As a result of a further embodiment the free ends of the two movable switching contacts move substantially in the same direction upon opening. Alternatively, the free ends of the two movable switching contacts can move away from each other upon opening.

According to one particular embodiment the pairs of switching contacts each have two movable switching contacts which move away from each other upon opening. The free ends of the switching contacts border the quenching packet. One of the movable switching contacts is electrically connected to the respective movable switching contact of the other switching contact, which moves substantially in the opposite direction upon opening.

Simultaneous opening of the pairs of switching contacts enables even faster opening compared with the preceding solution, meaning even faster establishing of an air break between in each case two switching contacts of a pair of switching contacts. The pairs of switching contacts can be opened by means in each case of an actuator. Alternatively or in addition, this can be done based on an electromagnetic repulsion of the switching contacts, in particular through the short-circuit current flowing through. In the latter instance the switching contacts are geometrically arranged and embodied such that substantially repelling forces will act upon the two movable switching contacts. That can be achieved by using, for example, a known U-shaped embodiment of the fixed contacts.

According to one embodiment the pairs of switching contacts each have two switching contacts that swivel away from each other upon opening. Alternatively, the pairs of switching contacts can each have two switching contacts that move away from each other in parallel upon opening.

A swiveling motion of the switching contacts does not take place in said two instances but, instead, a linearly guided motion of the switching contacts away from each other. The movable contacts will then preferably be movably connected to the connecting conductor or, as the case may be, conducting path via a movable stranded conductor.

According to another embodiment the quenching packet consists of an electrically non-conducting material. An example of such a material is a thermoplastic or ceramic material. The two arcs will be prevented thereby from taking the "shortcut" via the quenching packet. The voltage path necessary for quenching the current would no longer suffice in a case such as that and the current consequently not be interrupted or be interrupted too slowly.

The aforementioned quenching packet should preferably also have a partition made of an electrically non-conducting material. In that case it will be particularly reliably ensured that the two arcs will not combine while running in and so result in a shortcut through the quenching packet.

According to a further embodiment the quenching packet is made of an electrically conducting material, in particular a metal such as iron. In that case the quenching packet must have a partition made of an electrically non-conducting material. The particular advantage is that the two arcs can be quenched particularly quickly thanks to the large and fast heat-absorbing capability of the metallic quenching packet.

BRIEF DESCRIPTION OF THE DRAWINGS

The invention and advantageous embodiments thereof are described below with reference to the following figures, in which.

DETAILED DESCRIPTION OF INVENTION

Figure 1:
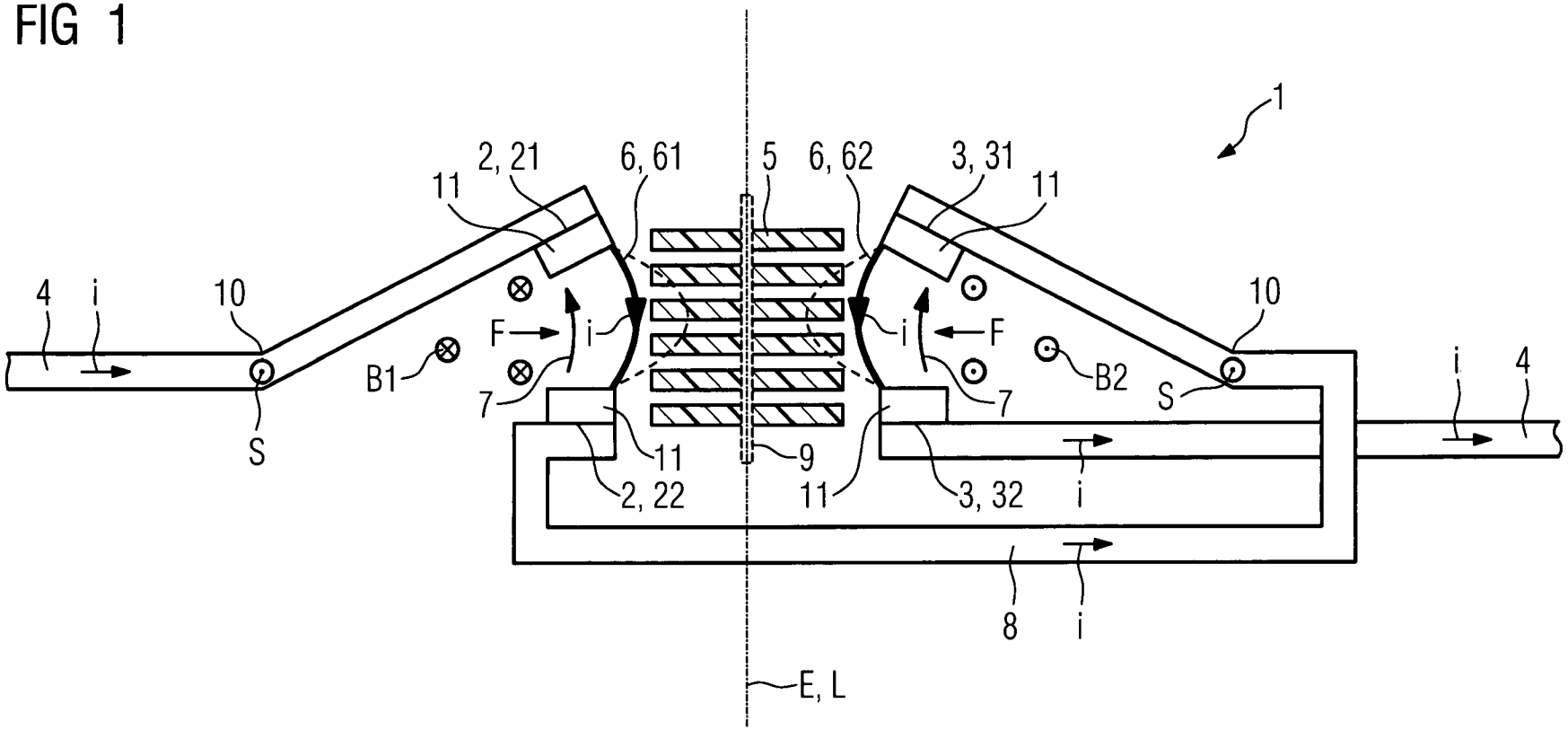
FIG. 1 shows a side view of an example of an inventive switching device according to a first embodiment.

FIG. 1 shows a side view of an example of an inventive switching device 1 according to a first embodiment. Provided in the switching device 1 shown are two pairs of switching contacts, identified by the reference numerals 2, 3, for interrupting a conducting path 4. The current i requiring to be interrupted by the inventive switching device 1 flows from left to right in FIG. 1. In the example shown in FIG. 1 the pairs of switching contacts 2, 3 each have a movable switching contact 21, 31 and a fixed contact 22, 32.

According to the invention the pairs of switching contacts 2, 3 are connected in series such that the same current i flowing in both arcs 6 flows spatially in the same direction. The current direction is symbolized by an arrow approximately in the center of the two arcs 6. For the present exemplary embodiment that is achieved through precisely one of the movable switching contacts 31 being electrically connected to the fixed contact 22 of the other pair of switching contacts 2. The remaining switching contacts 21, 32 are each connected via a connecting conductor 8 to the conducting path 4.

In the present FIG. 1 the current i coming from the left hence flows via the left-hand partial arc 61 of the first pair of switching contacts 2 from top to bottom. It continues flowing via the connecting conductor 8 to the movable switching contact 31 of the right-hand pair of switching contacts 3 to thence to continue flowing via the right-hand partial arc 62 likewise from top to bottom to the right-hand conducting path 4. The current directions would analogously be reversed were current i to flow from right to left into the switching device 1. In that case, too, the same current i flowing in both arcs 6 flows spatially in the same direction, meaning from bottom to top.

According to the invention the quenching packet 5 is furthermore disposed between the two opening paths 7, meaning between the free ends of the switching contacts 21, 22, 31, 32. The opening paths 7 are identified by an arrow pointing in a direction opposite that of the current. The pairs of switching contacts 2, 3 open in accordance with the representation shown from bottom to top. The two movable switching contacts 21, 31 are furthermore each mounted such that they can swivel around a pivotal center 10. Both free ends of the switching contacts 21, 31, meaning in particular the switching contact pieces 11 of the two switching contacts 21, 31, border the quenching packet 5.

As further shown in FIG. 1, the arcs 6 are both moved toward the quenching packet 5 by the Lorentz force F in effect. In this case the Lorentz force F is the cross product of the current i and the magnetic field, meaning of the magnetic induction B1, B2. For the left-hand partial arc 61 the current i flows perpendicularly to the magnetic field B1 generated in the partial arc 62 by the right-hand current i. The left-hand partial arc 61 is, as it were, pushed in the quenching packet 5 by the Lorentz force F. Shown in the right-hand part of FIG. 1 is the magnetic field B2 generated in the left-hand partial arc 61 by the left-hand current i. In this case the right-hand partial arc 62 is pushed to the left into the quenching packet 5 by the Lorentz force F in effect. This is symbolized by the dashed representation of the two arcs 6. The arcs 6 will hence both be cooled rapidly and the current i interrupted quickly.

A cutting plane that is perpendicular to the focal plane of FIG. 1 and relative to which the pairs of switching contacts 2, 3 are arranged symmetrically is identified by the reference letter E. The longitudinal extent or, as the case may be, axis of symmetry of the quenching packet 5 is identified by the reference letter L. A partition that electrically mutually separates the two arcs 6 is identified by the reference numeral 9. The plates, not further identified, of the quenching packet 5 itself are made of, for instance, an electrically non-conducting plastic such as, for instance, a thermoplastic material. The thermoplastic material can be, for example, a polybutylenterephthalate (=PBT) or a polyoximethylene (=POM). Thermoplastics of said type are characterized by high mechanical strength, very good dimensional stability, and excellent thermal aging characteristics.

The quenching packet 5 can moreover be made of a magnetic material, in particular a ferromagnetic material. The arcs 6 will in that case both be pushed even further into the quenching packet 5 shown by the magnetic reinforcement. An electrically non-conducting and simultaneously magnetically conducting plastic material can be, for example, a previously described thermoplastic material into whose matrix ferromagnetic particles such as metallic iron, cobalt, or nickel particles, or alloys thereof, have been introduced. A plastic material of said type preferably has a relative magnetic permeability of more than 10.

Alternatively the plastic material can also be an electrically conducting plastic material if a suitable electrically non-conducting partition 9 has been introduced into the quenching packet 5 for the purpose of electrically mutually separating the two pairs of switching contacts 2, 3. Conducting plastic materials can be produced, by for example, adding electrically conducting substances such as metals, carbon black, or graphite, or by suitably doping electrically non-conducting polymers.

Figure 2:
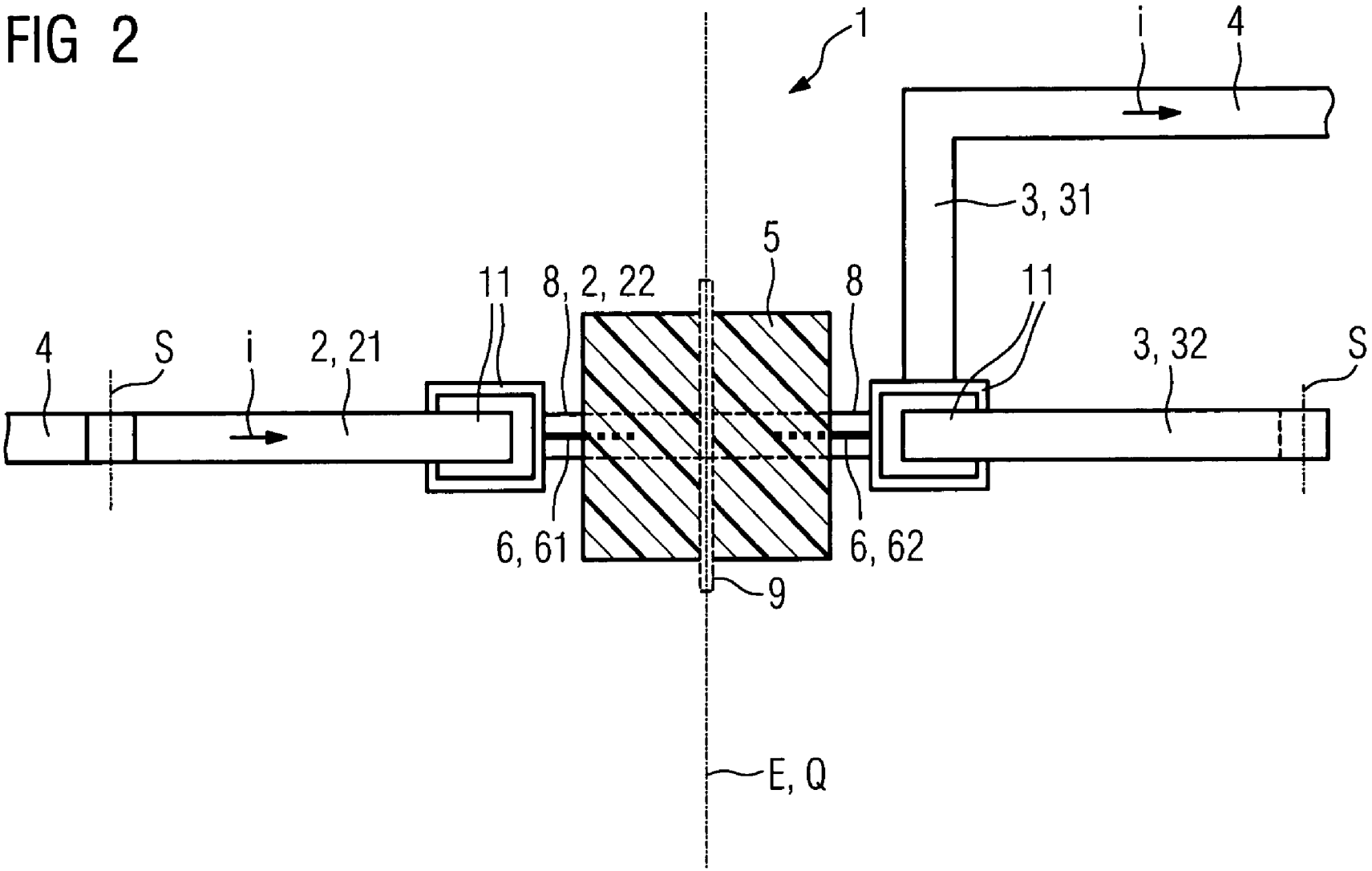
FIG. 2 shows a top view of the switching device shown in FIG. 1.

FIG. 2 shows a top view of the switching device 1 shown in FIG. 1. It can be seen in this representation that the connecting conductor 8 has been routed around the quenching packet 5 and the pair of switching contacts 3 for effecting a corresponding current flow in the reverse direction. A transverse axis of symmetry of the quenching packet 5 is identified by the reference letter Q. The swiveling axes of the switching contacts 21, 31 embodied as able to swivel are identified by the reference letter S.

Figure 3:
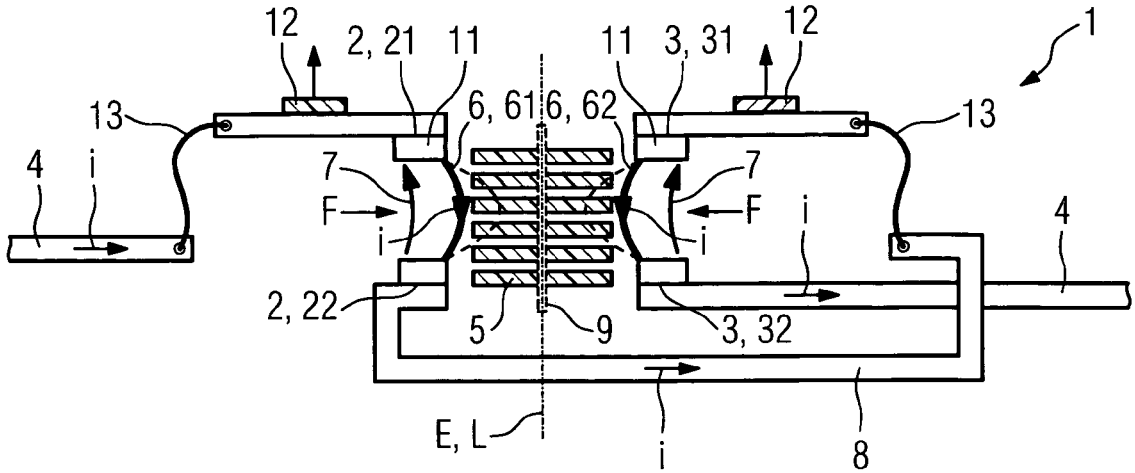
FIG. 3 shows a side view of a second embodiment of the inventive switching device.

FIG. 3 shows a side view of a second embodiment of the inventive switching device 1. In the example shown the movable switching contacts 21, 31 move linearly from bottom to top away from the fixed contacts 22, 32 along the opening path 7 that has been drawn. In the example shown in FIG. 3 they are each moved via an actuator identified by the reference numeral 12. The actuators 12 are preferably both combined into one actuator 12. The movable switching contacts 21, 31 are furthermore both electrically connected to the conducting path 4 or, as the case may be, connecting conductor 8 via a movable stranded conductor.

Figure 4:
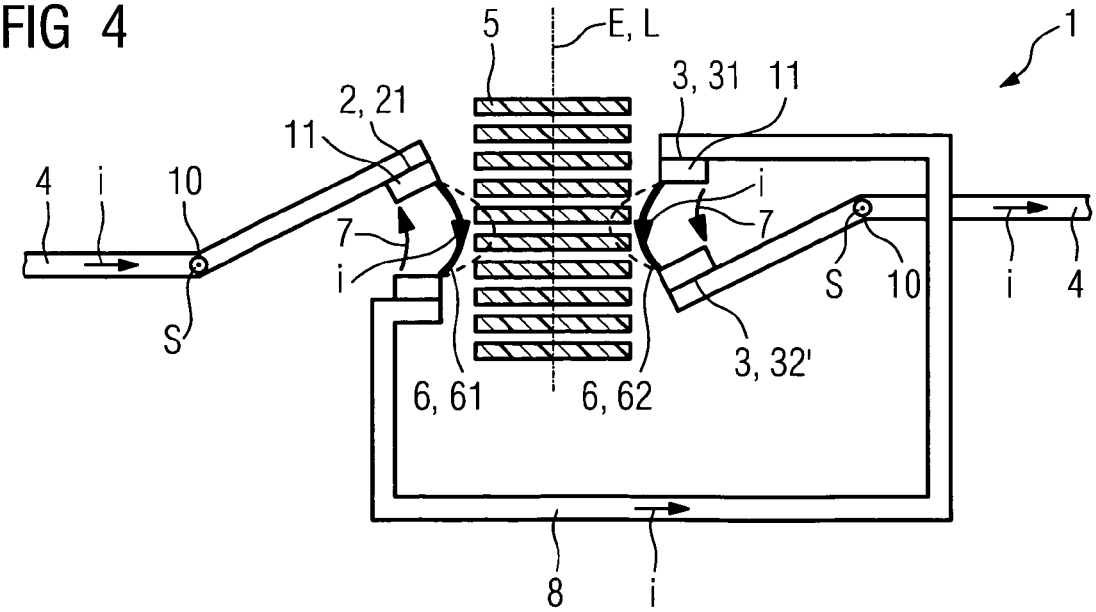
FIG. 4 shows a side view of a third embodiment of the inventive switching device.

FIG. 4 shows a side view of a third embodiment of the inventive switching device 1. In this case the free ends of both movable switching contacts 21, 32' are embodied such that they will move away from each other upon opening. The left-hand switching contact 21 shown therein moves from bottom to top. The right-hand movable switching contact 32' moves, by contrast, from top to bottom. In that embodiment, too, the arcs 6 are both pushed into the quenching packet 5 by the Lorentz force F in effect.

Figure 5:
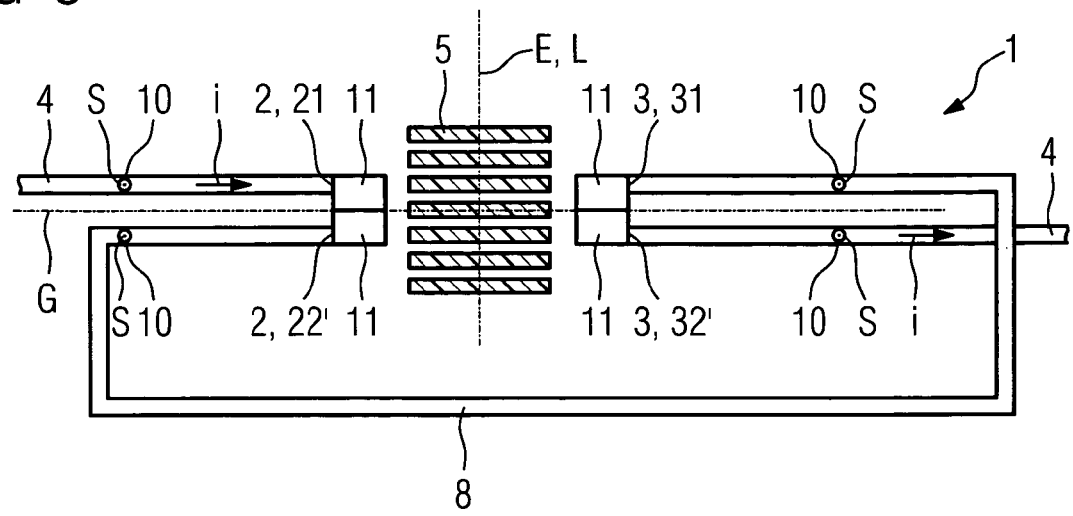
FIG. 5 shows a side view of a fourth embodiment of the inventive switching device with closed switching contacts.

FIG. 5 shows a side view of a fourth embodiment of the inventive switching device 1 with closed switching contacts 21, 22', 31, 32'. The latter are each arranged capable of swiveling around a pivotal center 10. In this arrangement the contact pieces 11 of the pairs of switching contacts 2, 3 lie in a basic plane G arranged perpendicularly to the cutting plane E. The pairs of switching contacts 2, 3 shown are arranged preferably mirror-symmetrically relative to the two planes G, E. The free ends of the switching contacts 21, 22', 31, 32' again border the quenching packet 5.

Figure 6:
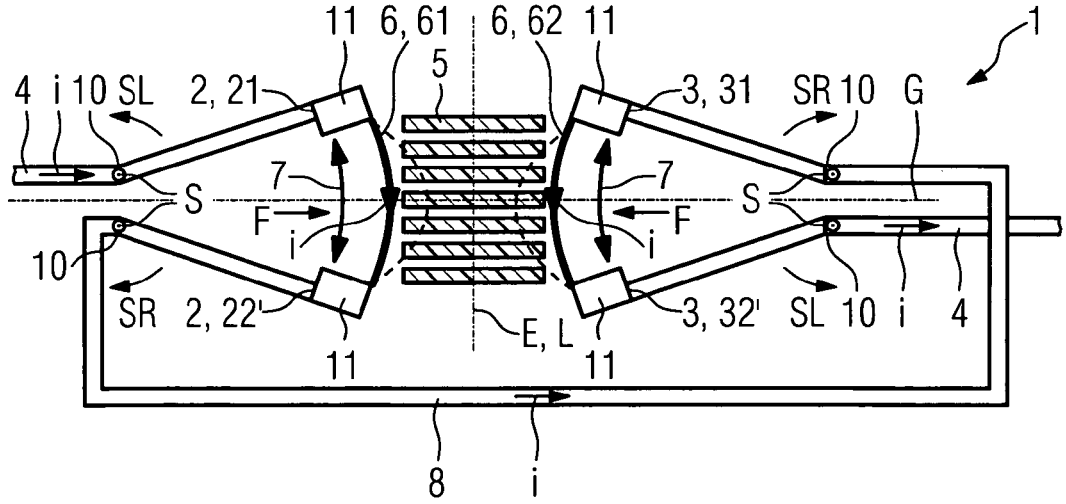
FIG. 6 shows the switching device shown in FIG. 5 with opening switching contacts.

FIG. 6 shows the switching device 1 shown in FIG. 5 with opening switching contacts 21, 22', 31, 32' that move away from each other. One of the movable switching contacts 22' is electrically connected to the respective movable switching contact 31 of the other pair of switching contacts 2, which contact moves substantially in the opposite direction upon opening. The movable switching contacts 21, 32' therein both swivel in a counterclockwise direction SL and the other movable switching contacts 22', 31 both swivel in a clockwise direction SR. In the case of that embodiment, too, the current i again flows in the same spatial direction, meaning from top to bottom.

As with all the embodiment variants shown, the current i in both arcs 6 flows in each case spatially in the same direction regardless of whether the current i flows from left to right or, conversely, from right to left via the conducting paths 4. The inventive switching device 1 is hence suitable for interrupting either direct currents or alternating currents.

The invention claimed is:

1. A switching device, comprising:

two pairs of series-connected switching contacts for interrupting a conducting path, wherein the pairs of switching contacts are arranged such that their opening paths are substantially mutually parallel or antiparallel and wherein the pairs of switching contacts are connected in series such that a same current flowing in both arcs flows spatially in a same direction; and an entire quenching packet for quenching arcs occurring when the conducting paths open, wherein the entire quenching packet is disposed between the two opening paths.

2. The switching device as claimed in claim 1, wherein the pairs of switching contacts each have a movable switching contact and a fixed contact, wherein one of the movable switching contacts is electrically connected to the fixed contact of the other pair of switching contacts, and wherein the remaining switching contacts are each connected to the conducting path.

3. The switching device as claimed in claim 2, wherein the two movable switching contacts are each mounted such that they can swivel around a pivotal center and in that both free ends of the movable switching contacts border the quenching packet.

4. The switching device as claimed in claim 3, wherein the free ends of both movable switching contacts move substantially in the same direction upon opening.

5. The switching device as claimed in claim 1, wherein the quenching packet consists of an electrically non-conducting material.

6. The switching device as claimed in claim 5, wherein the quenching packet has a partition made of an electrically non-conducting material.

7. The switching device as claimed in claim 1, wherein the quenching packet consists of an electrically conducting material, and wherein the quenching packet has a partition made of an electrically non-conducting material.

8. The switching device as claimed in claim 7, wherein the quenching packet consists of metal.

9. The switching device as claimed in claim 1, wherein the switching device is a power switching device.

* * * * *